US006745645B2

(12) United States Patent
Griffo

(10) Patent No.: US 6,745,645 B2
(45) Date of Patent: Jun. 8, 2004

(54) ENHANCED GAGE PROTECTION FOR MILLED TOOTH ROCK BITS

(75) Inventor: Anthony Griffo, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 48 days.

(21) Appl. No.: 10/083,888

(22) Filed: Feb. 27, 2002

(65) Prior Publication Data

US 2003/0159543 A1 Aug. 28, 2003

(51) Int. Cl.[7] ..... B21K 5/04
(52) U.S. Cl. ..... 76/108.2
(58) Field of Search ..... 76/108.2, 108.1; 175/331, 341

(56) References Cited

U.S. PATENT DOCUMENTS

| | | | | |
|---|---|---|---|---|
| 3,186,256 A | | 6/1965 | Reznick | |
| 3,386,322 A | | 6/1968 | Stone et al. | |
| 3,401,759 A | * | 9/1968 | White | 175/341 |
| 3,461,983 A | | 8/1969 | Hudson et al. | 175/375 |
| 3,513,728 A | | 5/1970 | Hudson et al. | 76/108 |
| 3,554,067 A | | 1/1971 | Scutella | |
| 3,861,016 A | | 1/1975 | Johnson et al. | |
| 3,946,631 A | | 3/1976 | Malm | |
| 3,952,815 A | | 4/1976 | Dysart | 175/374 |
| 4,077,161 A | | 3/1978 | Wyle et al. | |
| 4,396,077 A | | 8/1983 | Radtke | 175/329 |
| 4,637,289 A | | 1/1987 | Ramsden | |
| 4,762,028 A | * | 8/1988 | Regan | 376/108.2 |
| 4,805,504 A | | 2/1989 | Fushiya et al. | |
| 5,184,534 A | | 2/1993 | Lee | |
| 5,291,807 A | | 3/1994 | Vanderford et al. | 76/108.2 |
| 5,348,770 A | | 9/1994 | Sievers et al. | 427/422 |
| 5,950,514 A | | 9/1999 | Benedict et al. | |
| 6,418,829 B1 | | 7/2002 | Pilchowski | |

FOREIGN PATENT DOCUMENTS

| | | | |
|---|---|---|---|
| GB | 2 190 024 A | 11/1987 | B23P/15/32 |
| GB | 2 278 558 A | 12/1994 | B23P/15/32 |
| WO | WO 00/34002 | 6/2000 | B23P/25/00 |

* cited by examiner

*Primary Examiner*—Douglas D. Watts
(74) *Attorney, Agent, or Firm*—Osha & May L.L.P.

(57) ABSTRACT

A drill bit including a bit body having at least one roller cone rotatably coupled to the bit body with a plurality of milled teeth formed on the at least one roller cone is disclosed. At least one milled tooth is arranged so as to form a gage row milled tooth, and the gage row milled tooth includes hard-facing thereon. A cutting element insert is mounted in a gage face of the gage row milled tooth. A method of forming a drill bit structure, the method including machining at least one hole in a preselected location on a gage surface of at least one milled tooth, positioning a plug in the at least one hole, applying a hardfacing material to the at least one milled tooth, removing the plug from the at least one hole, and positioning a drilling insert in the at least one hole is also disclosed.

23 Claims, 2 Drawing Sheets

ENHANCED GAGE PROTECTION FOR MILLED TOOTH ROCK BITS

BACKGROUND OF INVENTION

1. Field of the Invention

The invention relates generally drill bits used to drill wellbores through earth formations. More specifically, the invention relates to a bit structure having reduced wear and method for applying hardfacing so as to reduce erosion of the drill bit during drilling operations.

2. Background Art

Drill bits used to drill wellbores through earth formations generally are made within one of two broad categories of bit structures. Drill bits in the first category are generally known as "fixed cutter" or "drag" bits, which usually include a bit body formed from steel or another high strength material and a plurality of cutting elements disposed at selected positions about the bit body. The cutting elements may be formed from any one or combination of hard or superhard materials, including, for example, natural or synthetic diamond, boron nitride, and tungsten carbide.

Drill bits of the second category are typically referred to as "roller cone" bits, which usually include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Application of hardfacing to the base material from which the cones and drill bit are formed is known in the art. The hardfacing can be applied in the form of special erosion protection inserts used in addition to the cutting elements. See for example, U.S. Pat. No. 3,952,815 issued to Dysart. Another method known in the art that uses hardfacing to protect insert bit roller cones is described in U.S. Pat. No 5,291,807 issued to Vanderford. The method in the Vandeford '807 patent includes marking the face of a roller cone by masking or etching, applying hardfacing material, such as tungsten carbide, in the form of a powder, and heating the cone to bond the hardfacing powder to the cone. This technology has shown problems of concentration erosion of cone steel between carbide insert and hardfacing patch. U.S. Pat. Nos. 3,461,983 and 3,513,728 issued to Hudson include disclosure related to drilling holes (sockets) in the cone prior to application of the hardfacing, plugging the holes, and then applying the hardfacing material using a flame application process. After applying the hardfacing material with the flame process, the plugs are removed and the inserts are pressed into the previously drilled sockets. One issue with this technology is distortion from quench operation or damage to cone due to thermal mismatch between plug and cone. Note, this technology requires the plug to remain in the insert hole through processing.

Moreover, U.S. Pat. No. 5,348,770 issued to Sievers discloses a method for applying hardfacing to a cone which uses a high velocity oxygen fuel (HVOF) spray process after the cone is formed. Forming the cone includes drilling the sockets for the inserts. Those skilled in the art know that HVOF coatings applied to a finished or formed cone have poor impact and bonding due to temperature limitations, that is, temperature is restricted by either the steel temper or required carburized case. Both effectively limit cone heating to below 500° F. U.S. Pat. No. 4,396,077 issued to Radtke discloses a method for applying hardfacing to a fixed cutter bit. The method includes generating an electric arc and spraying arc-heated hardfacing material onto a substantially completely assembled bit structure.

With respect to milled tooth bits, regardless of how the hardfacing is applied, the hardfacing material resists wear as the gage row teeth cut a gage of an earth formation. As the gage row milled teeth wear, along with the hardfacing material, the gage of the borehole will be reduced depending on the amount of wear of the gage row milled teeth. As the gage row milled teeth continue to wear, the cutting capability of the cone is reduced.

What is needed, therefore, is a structure and method for enhancing the durability of gage row milled teeth without sacrificing reliability of the cutting structure.

SUMMARY OF INVENTION

In one aspect, the present invention relates to a drill bit including a bit body having at least one roller cone rotatably coupled to the bit body with a plurality of milled teeth formed on the at least one roller cone, at least one milled tooth arranged so as to form a gage row milled tooth, the gage row milled tooth includes hardfacing thereon, and a cutting element insert mounted in the gage row milled tooth.

In another aspect, the present invention relates to a method of forming a drill bit structure, the method including machining at least one hole in a preselected location on a gage surface of at least one milled tooth, positioning a plug in the at least one hole, applying a hardfacing material to the at least one milled tooth, removing the plug from the at least one hole, and positioning a drilling insert in the at least one hole. Critical to this process is maintenance of gage dimension or outside diameter of bit. Loss of gage dimension due to wear of cutting structure results in decreased bit performance as well as increase operating costs due to hole reaming or cleaning.

Other aspects and advantages of the invention will be apparent from the following description and the appended claims.

DETAILED DESCRIPTION

Figure 1:
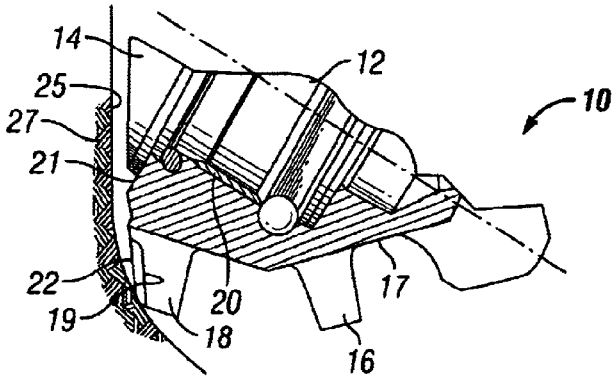
FIG. 1 (Prior Art)
FIG. 1 shows a partial cross-section of a prior art cone illustrating a single gage cutting row of milled teeth.

The present invention relates to a structure and method for reducing wear on the gage row of milled teeth. FIG. 1 shows a partial cross-section of a typical prior art milled tooth roller cone rock bit 10. FIG. 1 shows a milled tooth roller cone rock bit 10 assembled onto a journal bearing 12 cantilevered from the bottom of a leg 14 extending from a body (not shown) of a milled tooth roller cone rock bit 10. A plurality of rows of milled teeth 16 project from the surface 17 of the cone 10. A gage row of milled teeth 18 are disposed adjacent a cylindrical bearing cavity 20 formed through a base 21 of the cone 10. In this example, a groove 19 has been machined on the cutting side of the gage row of milled teeth 18. The groove 19 is filled with a hardfacing material 22 (in a manner as described above) to bring each gage row tooth 18 out to a gage diameter of the cone 10. The hardfacing material 22 resists wear as the gage row teeth 18 cut the gage 25 of an earth formation 27. As the gage row milled teeth 18 wear, along with the hardfacing material 22, the gage 25 of the borehole will be reduced depending on the amount of wear of the gage row milled teeth 18. As the gage row milled teeth 18 continue to wear, the cutting capability of the cone 10 is reduced.

Figure 2:
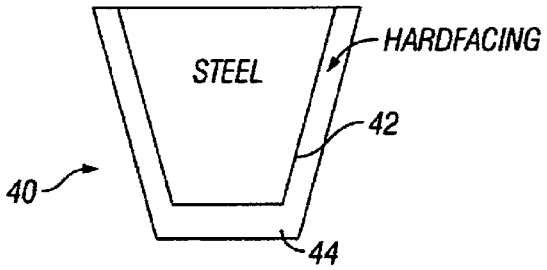
FIG. 2 shows a typical prior art gage cutting row milled tooth having a hardfacing layer disposed thereon.

An alternative prior art structure is shown in FIG. 2. In FIG. 2, a gage row milled tooth 40 is shown. An outer surface gage row milled tooth 42 is completely coated with a hardfacing layer 44. As in the above embodiment, as the gage row milled tooth 40 cuts the gage of an earth formation (not shown), the hardfacing layer 44 and the gage row milled tooth 40 wear, resulting in a diminished cutting capability.

As used herein, the term "erosion" refers to both erosion and other abrasive wear. Substantial erosion of the roller cone 10 typically occurs at the gage row milled teeth 18. This area on a roller cone must generally be protected to increase the longevity of the drill bit in both normal and harsh drilling conditions. For example, erosion in this areas may result in damage to the roller cone.

Accordingly, embodiments of the present invention relate to methods and structures for extending longevity and performance of a milled tooth bit, especially in harsh drilling conditions. In some embodiments of the invention, hardfacing coatings may be applied with an arc process as described in U.S. Pat. No. 6,196,338 issued to Slaughter et al. and assigned to the assignee of the present invention. For example, the hardfacing may be applied with a plasma transferred arc process (PTA), a gas-shielding tungsten arc (also known as "gas tungsten arc") welding process, a metal inert gas arc ("gas metal arc") welding process, and similar processes known in the art.

In some embodiments, an electric arc such as that formed by the PTA process is preferred because an area of a cone heated for application of hardfacing may be closely controlled. Advantageously, close control of the heated area prevents damage to a large area of the cone that may be produced with, for example, an unshielded chemical flame.

The following detailed discussion describes various aspects of the invention. The hardfacing techniques described below may be used to apply a hardfacing coating to any drill bit structure such as, for example, a roller cone or a drill bit shoulder. Accordingly, descriptions related to application of hardfacing coatings to roller cones are not intended to limit the scope of the invention to a single use (e.g., hardfacing roller cones). Further, while some embodiments are described with respect to insertion of cutting elements into machined holes in a drill bit structure, other types of drilling inserts (where the term drilling inserts is intended to include cutting elements), such as gage protection elements, may be used within the scope of the invention. Accordingly, the examples provided in the description below are not intended to be limiting with respect to, for example, a specific type of drilling insert.

Figure 3A:
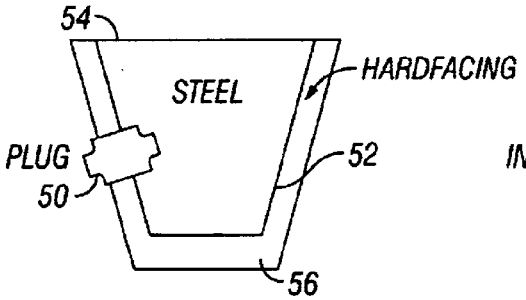
FIG. 3A shows a cross-sectional view of plugs affixed to a surface of a drill bit structure in accordance with an embodiment of the invention.

In one embodiment of the invention shown in FIG. 3A, a plug 50 is disposed on a surface 52 of a gage row milled tooth 54 that is disposed on a milled tooth roller cone (not shown) in a manner similar to that described above. The plug 50 may comprise, for example, graphite, oxide ceramics (including porous alumina, porous silica, mullite, and the like), soft metals (including copper and the like), and other suitable materials known in the art. Moreover, coated metals, metallized plastic, heat resistant plastic, and the like may also be used with embodiments of the invention.

The plug 50 may be positioned at selected locations on the surface 52 of the gage row milled tooth 54. The positioning of the plug 50 is adapted to correspond to, for example, desired locations of a cutting element insert that will be affixed to the gage row milled tooth 54 after a hardfacing material has been applied thereto. The plug 50 may be affixed (e.g., adhesively, metallurgically, or mechanically bonded) to the outer gage surface 52 of the gage row milled tooth 54 in a selected location. Hardfacing material 56 may then be applied to the surface 52 of the gage row milled tooth 54 so that the plug 50 remain substantially exposed (as shown in FIG. 3A). After the hardfacing material 56 has been applied, the plug 50 may be removed by any means known in the art (e.g., by breaking, chipping, and/or drilling out the plugs) so that a hole adapted to receive cutting element inserts, gage protections inserts, and the like may be drilled (e.g., machined) in the non-hardfaced portions of the roller cone (formerly occupied by the plugs). Note that, in other embodiments, the plugs may be substantially covered with hardfacing material during the coating process.

Figure 3B:
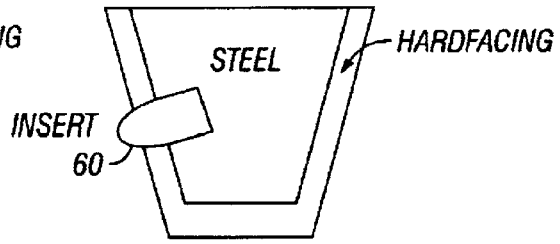
FIG. 3B shows a cross-sectional view of a hardfaced drill bit structure in accordance with an embodiment of the invention.

After hardfacing has been completed, and because the hardfacing material 56 generally does not adhere to the plugs in the same manner as the hardfacing material 56 adheres to a base metal of the gage row milled tooth 54 (e.g., because the hardfacing material 56 generally does not form a metallurgical or mechanical bond with the plug 50), the portions of the hardfacing material 56 proximate the plug 50 may be removed so that a cutting element insert hole (not shown) may be drilled as described above. After the hole (not shown) has been drilled in the gage row milled tooth 54, a cutting element insert 60 (shown in FIG. 3B) may be affixed in the hole (not shown) by interference fit, brazing, and/or other means known in the art. The type of cutting element insert used is not intended to be limiting, and any insert known in the art may be used in conduction with the present invention. In addition, while reference has been made to a single insert/plug system, it is expressly within the scope of the present invention that some or all of the gage row milled teeth may have inserts disposed therein.

Figure 4:
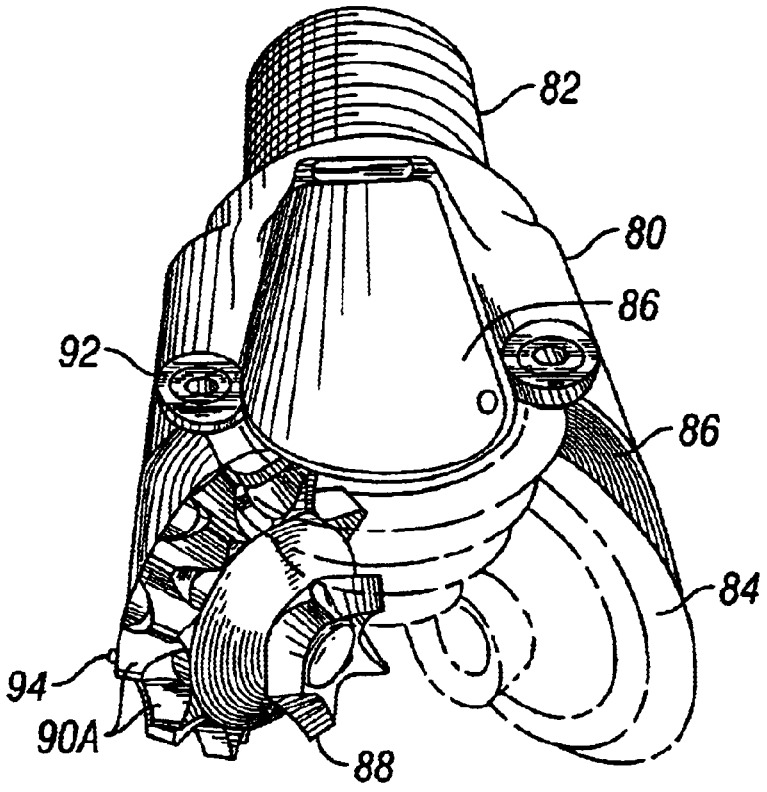
FIG. 4 shows a drill bit in accordance with one embodiment of the present invention.

FIG. 4 shows a drill bit in accordance with an embodiment of the present invention. In FIG. 4, a milled tooth roller cone drill bit includes a steel body 80 having a threaded coupling ("pin") 82 at one end for connection to a conventional drill string (not shown). At the opposite end of the drill bit body 80 there are three roller cones 84, for drilling earth formations. Each of the roller cones 84 is rotatably mounted on a journal pin (not shown in FIG. 1) extending diagonally inwardly on each one of the three legs 86 extending downwardly from the bit body 80. As the bit is rotated by the drill string (not shown) to which it is attached, the roller cones 84 effectively roll on the bottom of the wellbore being drilled. The roller cones 84 are shaped and mounted so that as they roll, teeth 88 on the cones 84 gouge, chip, crush, abrade, and/or erode the earth formations (not shown) at the bottom of the wellbore. Milled teeth 90 in the row around the heel of the cone 84 are referred to as the "gage row" milled teeth. They engage the bottom of the hole being drilled near its perimeter or "gage." Fluid nozzles 92 direct drilling fluid ("mud") into the hole to carry away the particles of formation created by the drilling. Cutting element 94 is mounted in at least one gage row milled tooth 90A. The placement of cutting element 94 in at least one gage row milled tooth 90A, helps to retain the gage hole without reducing the rate of penetration of the drill bit. The cutting element 94 may be, for example, a tungsten carbide insert.

Figure 5:
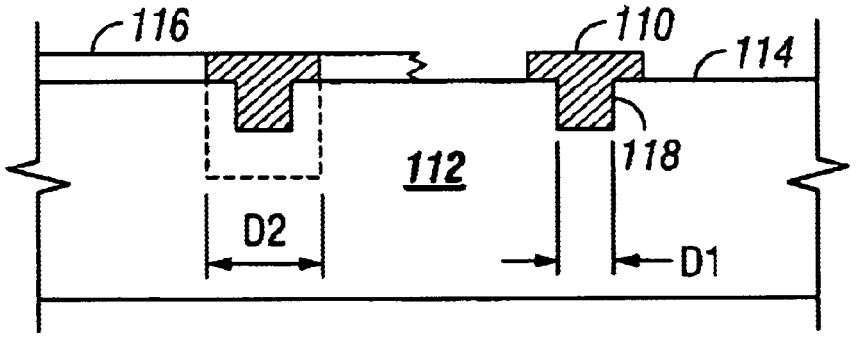
FIG. 5 shows a cross-sectional view of a hardfaced drill bit structure in accordance with an embodiment of the invention.

In another embodiment of the invention shown in FIG. 5, holes 118 having a diameter D1 may be machined in a roller cone 112 prior to hardfacing. Plug inserts typically referred to as "mushroom caps" 110 may be inserted into the holes 118. Hardfacing material 116 may then be applied to a surface 114 of the roller cone 112 and/or other selected portions of the drill bit (not shown), and the mushroom caps 110 may be either substantially exposed or substantially covered after application of the hardfacing material 116 (as in the embodiments described above). The mushroom caps 110 may be removed from the roller cone 112 after hardfacing material 116 has been applied thereto. After removal of the mushroom caps 110, the holes 118 may be enlarged to a diameter D2 so as to form cutting element insert holes (not shown) so that cutting element inserts (not shown) may be affixed in the insert holes by brazing and/or other means known in the art. In this manner, the mushroom caps 110 act as both plugs and plug inserts and enable an insert hole to be enlarged to the desired diameter D2 after hardfacing material 116 has been applied to the roller cone 112.

The mushroom caps 110 may be formed from any suitable material known in the art. For example, the mushroom caps 110 may be formed from the materials described above with respect to the plugs and plug inserts of the previous embodiments.

The previous embodiments related to the use of, for example, inserts as plugs for the positioning of cutting element inserts generally include application of hardfacing materials using the aforementioned arc processes. Moreover, high velocity oxygen fuel (HVOF) processes may also be used to apply hardfacing in these embodiments of the invention. In a preferred embodiment, the hardfacing material is applied via an electric arc process. The electric arc process enables the hardfacing material application to be closely controlled so that, for example, only selected portions of the roller cone and/or drill bit to be hardfaced are heated to elevated temperatures during the hardfacing process. In addition, it is expressly within the scope of the present invention that other methods of applying hardfacing may be used, such as those described in U.S. application Ser. No. 09/974,735, which is assigned to the assignee of the present invention, and is incorporated by reference.

Advantageously, the above described embodiments of the invention precise application of a selected pattern of hardfacing material to the roller cone or other surface that is to be coated for erosion protection. In this manner, the invention helps avoid formation of a hardened layer that is difficult to machine when, for example, cutting element inserts holes are later drilled for installation of cutting element inserts. Further, incorporation of an insert into the gage row milled teeth provides a more wear-resistant structure than gage row milled teeth without an insert.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of forming a drill bit structure, the method comprising:

machining at least one hole in a preselected location on a gage surface of at least one milled tooth;

positioning a plug in the at least one hole;

applying a hardfacing material to the at least one milled tooth;

removing the plug from the at least one hole; and positioning a drilling insert in the at least one hole.

2. The method of claim 1, wherein the plug comprises graphite.

3. The method of claim 1, wherein the plug comprises oxide ceramic.

4. The method of claim 1, wherein the plug comprises soft metal.

5. The method of claim 1, wherein the plug comprises heat resistant plastic.

6. The method of claim 1, wherein the plug comprises a mushroom cap.

7. The method of claim 1, wherein the applying comprises depositing the hardfacing material using an arc process.

8. The method of claim 1, wherein the applying comprises depositing the hardfacing material using a high velocity oxygen fuel process.

9. The method of claim 1, wherein the positioning drilling inserts comprises brazing drilling inserts in each hole.

10. A method of forming a drill bit structure, the method comprising:

affixing a plurality of plugs to the drill bit structure at preselected locations on a gage surface of at least one milled tooth;

applying a hardfacing material to the at least one milled tooth;

removing the plurality of plugs;

machining holes in the at least one milled tooth proximate the preselected locations; and positioning drilling inserts in each hole.

11. The method of claim 10, wherein the drill bit structure comprises at least one roller cone.

12. The method of claim 11, further comprising arranging the plurality of plugs in substantially circumferential rows on the at least one roller cone.

13. The method of claim 10, wherein the drill bit structure comprises at least one shoulder of a bit body.

14. The method of claim 13, further comprising arranging the plurality of plugs in rows on the at least one shoulder.

15. The method of claim 10, wherein the plugs comprise graphite.

16. The method of claim 10, wherein the plugs comprise oxide ceramic.

17. The method of claim 10, wherein the plugs comprise soft metal.

18. The method of claim 10, wherein the plugs comprise heat resistant plastic.

19. The method of claim 10, wherein the plugs comprise mushroom caps.

20. The method of claim 10, wherein the affixing comprises adhesively bonding the plurality plugs to the drill bit structure.

21. The method of claim 10, wherein the applying comprises depositing the hardfacing material using an arc process.

22. The method of claim 10, wherein the applying comprises depositing the hardfacing material using a high velocity oxygen fuel process.

23. The method of claim 10, wherein the positioning drilling inserts comprises brazing drilling inserts in each hole.

* * * * *